US010509349B2

(12) United States Patent
Izumiya et al.

(10) Patent No.: US 10,509,349 B2
(45) Date of Patent: Dec. 17, 2019

(54) FIXING DEVICE AND IMAGE FORMING APPARATUS

(71) Applicant: Konica Minolta, Inc., Tokyo (JP)

(72) Inventors: Kenji Izumiya, Tokyo (JP); Takumi Shirakuma, Tokyo (JP); Keigo Ogura, Tokyo (JP); Hidenori Mine, Tokyo (JP); Hirokatsu Kodama, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/182,826

(22) Filed: Nov. 7, 2018

(65) Prior Publication Data

US 2019/0146397 A1 May 16, 2019

(30) Foreign Application Priority Data

Nov. 10, 2017 (JP) ..... 2017-217381

(51) Int. Cl.
*G03G 15/20* (2006.01)
*G03G 15/00* (2006.01)

(52) U.S. Cl.
CPC ..... *G03G 15/2053* (2013.01); *G03G 15/553* (2013.01)

(58) Field of Classification Search
CPC ..... G03G 15/206; G03G 15/2017; G03G 15/2032; G03G 15/2046; G03G 15/2053; G03G 2215/2003
See application file for complete search history.

(56) References Cited

U.S. PATENT DOCUMENTS

2005/0220473 A1* 10/2005 Bott ..... G03G 15/2064 399/67
2011/0311246 A1* 12/2011 Masuda ..... G03G 15/2064 399/33

FOREIGN PATENT DOCUMENTS

JP 2011-059172 A 3/2011
JP 2016218399 A * 12/2016

OTHER PUBLICATIONS

JP 2016218399 English machine translation, Yamaoka et al., Dec. 22, 2016 (Year: 2016).*

* cited by examiner

*Primary Examiner* — Thomas S Giampaolo, II
(74) *Attorney, Agent, or Firm* — Buchanan Ingersoll & Rooney PC

(57) ABSTRACT

A fixing device includes a first fixing section, a second fixing section, the first fixing section and the second fixing section forming a fixing nip therebetween, a nip width adjusting section capable of adjusting a nip width of the fixing nip, a rotation speed detecting section that detects a rotation speed of the second fixing section, and a hardware processor that controls the nip width adjusting section to make the nip width equal to a predetermined reference nip width.

21 Claims, 7 Drawing Sheets

FIXING DEVICE AND IMAGE FORMING APPARATUS

CROSS REFERENCE TO RELATED APPLICATIONS

The entire disclosure of Japanese patent Application No. 2017-217381, filed on Nov. 10, 2017, is incorporated herein by reference in its entirety.

BACKGROUND

Technological Field

The present invention relates to a fixing device and an image forming apparatus.

Description of Related Art

Generally, an image forming apparatus (a printer, a copier, a fax, or the like) utilizing an electrophotographic process technology irradiates (exposes) a charged photoreceptor drum (image carrier) with (to) laser light based on image data to form an electrostatic latent image. Then, toner is supplied from a developing device to the photoreceptor drum on which the electrostatic latent image is formed to visualize the electrostatic latent image, thereby forming a toner image. Further, after this toner image is directly or indirectly transferred to a sheet, heating and pressurizing the sheet at a fixing nip causes the toner image to be formed on the sheet.

In the image forming apparatus, various types of media are used. Various types of media include media having different basis weights, media to which coatings are applied, media to which no coating is applied, media made of different materials, media of different paper types such as an envelope and embossed paper. However, appropriate nip widths of media at the fixing nip may be different from each other, which requires that appropriate nip widths of various media be managed in order to fix an image onto such media with high quality.

For example, for thick paper, it is preferable to increase the nip width in order to firmly transfer heat to the thick paper in a fixing section. In contrast, for thin paper, it is preferable to decrease the nip width because the thin paper does not require a large amount of heat and easily wrinkles if the nip width is large.

For example, a configuration where, in order to change the nip width according to a medium, an inter-shaft distance between a first fixing roller and a second fixing roller that form a fixing nip is set variable to allow the nip width for each medium to be set is well known. However, as the diameter and hardness of the roller vary due to the influence of heat or pressure, the nip width varies accordingly, which makes it impossible to maintain the nip width once set.

In view of the above, Japanese Patent Application Laid-Open No. 2011-59172 discloses a configuration where an inter-shaft regulating member is provided between bearings of both rollers and is configured to expand to keep the distance between both the rollers, which keeps the fixing nip constant.

SUMMARY

However, in the technique described in Japanese Patent Application Laid-Open No. 2011-59172, it is only expected that the variation in the nip width is canceled by the expansion of the inter-shaft regulating member, and it is still impossible to accurately adjust the nip width in accordance with a change in the hardness or diameter of the roller due to the influence of heat or pressure. For example, when the nip width varies depending on a degree of expansion of the fixing member due to a change in a warm-up state in a fixing device or a condition other than media such as a degree of sag in the fixing member, a problem arises that fixability is deteriorated, or fixing failure, for example, generation of wrinkles on thin paper occurs while the thin paper is passing through.

Note that the configuration described in Japanese Patent Application Laid-Open No. 2011-59172 is not intended to measure the actual nip width; thus, the configuration is sometimes unable to accurately adjust the nip width and has a certain limitation as a configuration that suppresses fixing failure due to the change in the nip width.

An object of the present invention is to provide a fixing device and an image forming apparatus that suppress fixing failure due to a change in a nip width.

In order to achieve at least one of the above objects, a fixing device reflecting an aspect of the present invention is a fixing device that fixes a toner image onto a sheet passing through a fixing nip, including:

a first fixer that receives a first drive force to rotate;

a second fixer that rotates following rotation of the first fixer, the first fixer and the second fixer forming the fixing nip therebetween;

a nip width adjuster capable of adjusting a nip width of the fixing nip;

a rotation speed detector that detects a rotation speed of the second fixer; and a hardware processor that controls the nip width adjuster based on a detection result of the rotation speed detector to make the nip width equal to a predetermined reference nip width.

In order to achieve at least one of the above objects, an image forming apparatus reflecting an aspect of the present invention includes:

a first fixer that receives a first drive force to rotate;

a second fixer that rotates following rotation of the first fixer, the first fixer and the second fixer forming a fixing nip therebetween;

a nip width adjuster capable of adjusting a nip width of the fixing nip;

a rotation speed detector that detects a rotation speed of the second fixer; and a hardware processor that controls the nip width adjuster based on a detection result of the rotation speed detector to make the nip width equal to a predetermined reference nip width.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
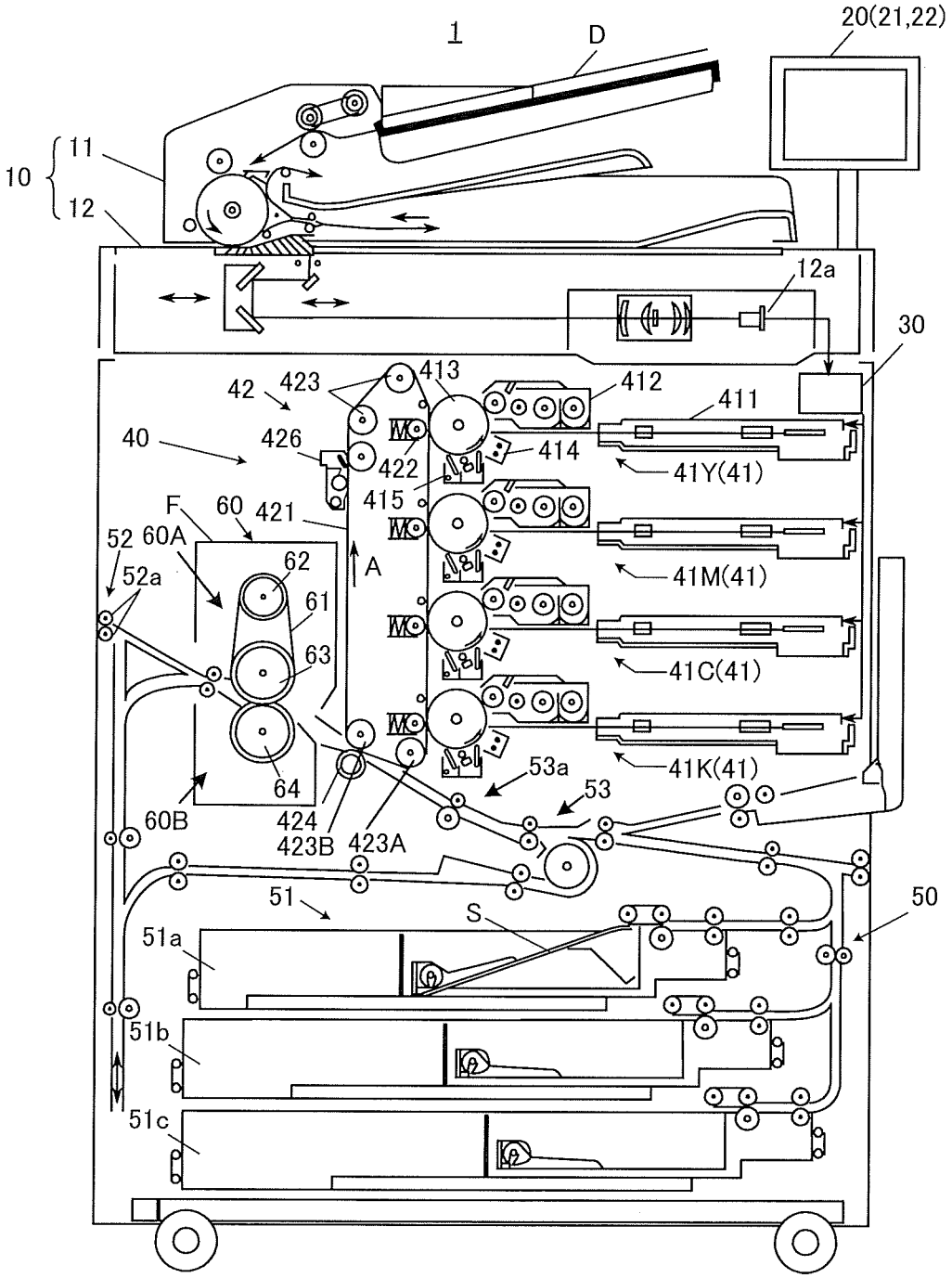
FIG. 1 is a diagram schematically showing an overall configuration of an image forming apparatus according to the present embodiment.
Figure 2:
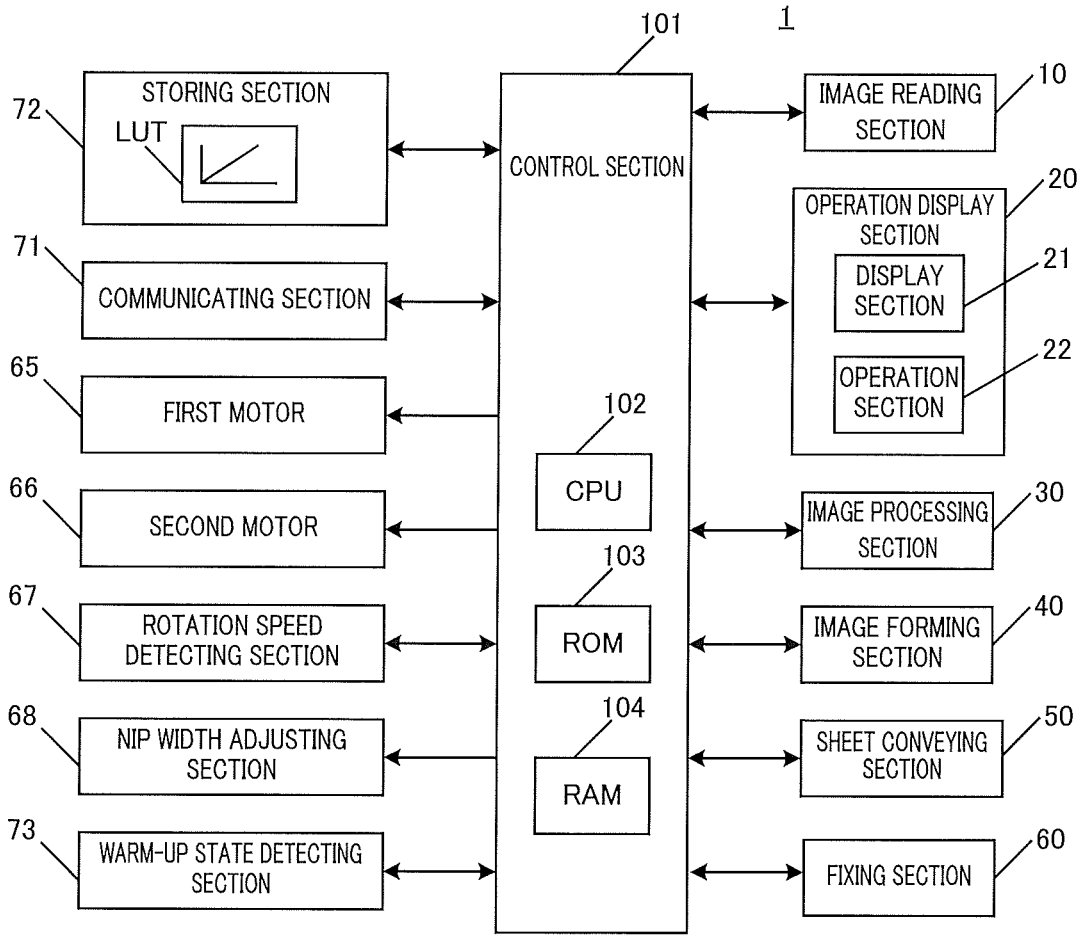
FIG. 2 is a diagram showing a main part of a control system of the image forming apparatus according to the present embodiment.

Hereinafter, the present embodiment will be described in detail with reference to the drawings. FIG. 1 is a diagram schematically showing an overall configuration of image forming apparatus 1 according to the present embodiment. FIG. 2 is a diagram showing a main part of a control system of image forming apparatus 1 according to the present embodiment.

As shown in FIG. 1, image forming apparatus 1 is a color image forming apparatus of intermediate transfer type using an electrophotographic process technology. That is, image forming apparatus 1 primarily transfers each color toner image, that is, a yellow (Y) tonner image, a magenta (M) toner image, a cyan (C) toner image, and a black (K) toner image, formed on a corresponding photoreceptor drum 413 to intermediate transfer belt 421 to cause the four color toner images to be superimposed on top of one another on intermediate transfer belt 421, and then secondarily transfers the four color toner images onto sheet S fed out from one of sheet feeding tray units 51*a* to 51*c* to form an image.

Further, for image forming apparatus 1, a tandem-type configuration is employed in which respective photoreceptor drums 413 of the four colors Y, M, C, and K are arranged in series in a travel direction of intermediate transfer belt 421, and the color toner images are sequentially transferred to intermediate transfer belt 421 in a single step.

As shown in FIG. 2, image forming apparatus 1 includes image reading section 10, operation display section 20, image processing section 30, image forming section 40, sheet conveying section 50, fixing section 60, and control section 101.

Control section 101 includes central processing unit (CPU) 102, read only memory (ROM) 103, random access memory (RAM) 104, and the like. CPU 102 reads a program corresponding to processing contents from ROM 103 and loads the program to RAM 104, and cooperates with the program thus loaded for centralized control of an operation of each block and the like of image forming apparatus 1. At this time, various types of data stored in storing section 72 are referred to. Storing section 72 is, for example, a non-volatile semiconductor memory (so-called flash memory) or a hard disk drive.

Control section 101 transmits and receives, via communicating section 71, various types of data to and from an external apparatus (for example, a personal computer) connected to a communication network such as a local area network (LAN) or a wide area network (WAN). Control section 101 receives, for example, image data (input image data) transmitted from the external apparatus, and causes an image to be formed on sheet S based on the image data. Communicating section 71 is, for example, a communication control card such as a LAN card.

As shown in FIG. 1, image reading section 10 includes automatic document feeding device 11 called an auto document feeder (ADF), document image scanning device 12 (scanner), and the like.

Automatic document feeding device 11 causes a conveying mechanism to convey document D placed on a document tray to document image scanning device 12. Automatic document feeding device 11 allows images (including images on both sides) of a large number of documents D placed on the document tray to be continuously read all at once.

Document image scanning device 12 optically scans a document conveyed onto a contact glass from automatic document feeding device 11 or a document placed on the contact glass and forms an image from light reflected from the document on a light receiving surface of charge coupled device (CCD) sensor 12*a* to read a document image. Image reading section 10 generates input image data based on a reading result of document image scanning device 12. The input image data is subjected to predetermined image processing in image processing section 30.

As shown in FIG. 2, operation display section 20 is, for example, a liquid crystal display (LCD) with a touch panel, and functions as display section 21 and operation section 22. Display section 21 displays various operation screens, an image state, an operation status of each function, and the like in accordance with a display control signal input from control section 101. Operation section 22 includes various operation keys such as numeric keys and a start key, receives various input operations performed by a user, and outputs an operation signal to control section 101.

Image processing section 30 includes a circuit or the like that performs digital image processing on the input image data in accordance with a default setting or a user specific setting. For example, image processing section 30 performs tone correction based on tone correction data (tone correction table) under the control of control section 101. In addition to the tone correction, image processing section 30 performs various correction processing such as color correction and shading correction, compression processing, and the like on the input image data. Image forming section 40 is controlled based on the image data subjected to the above-described processing.

As shown in FIG. 1, image forming section 40 includes image forming units 41Y, 41M, 41C, and 41K, intermediate transfer unit 42, and the like for forming images with color toners of Y component, M component, C component, and K component based on the input image data.

Image forming units 41Y, 41M, 41C, and 41K for Y component, M component, C component, and K component have the same configuration. For convenience of illustration and explanation, the same constituent elements are denoted by the same reference numeral, and when the constituent elements need to be distinguished from each other, Y, M, C, or K is added to the reference numeral. In FIG. 1, only the constituent elements of image forming unit 41Y for Y component are given reference numerals, but no reference numerals are given to the constituent elements of other image forming units 41M, 41C, and 41K.

Image forming unit 41 includes exposing device 411, developing device 412, photoreceptor drum 413, charging device 414, drum cleaning device 415, and the like.

Photoreceptor drum 413 is, for example, an organic photoreceptor that is, for example, a drum-shaped metal base having a photoreceptor layer formed on an outer peripheral surface thereof, the photoreceptor layer being made of resin containing an organic photoconductor.

Control section 101 controls a drive current supplied to a drive motor (not shown) that rotates photoreceptor drum 413 to rotate photoreceptor drum 413 at a constant peripheral speed.

Charging device 414 is, for example, an electrostatic charger that generates a corona discharge to uniformly cause the surface of photoreceptor drum 413 having photoconductivity to be negatively charged.

Exposing device 411 is, for example, a semiconductor laser that irradiates photoreceptor drum 413 with laser light corresponding to an image of each color component. As a result, an electrostatic latent image of each color component is formed in an image area irradiated with the laser light on the surface of photoreceptor drum 413 due to a potential difference from a background area.

Developing device 412 is a developing device of two-component reversal type that causes a developer of each color component to adhere to the surface of photoreceptor drum 413 to visualize the electrostatic latent image, thereby forming a toner image.

To developing device 412, for example, a DC developing bias having the same polarity as a charging polarity of charging device 414, or a developing bias in which a DC voltage having the same polarity as the charging polarity of charging device 414 is superimposed on an AC voltage is applied. As a result, reversal development for causing toner to adhere to the electrostatic latent image formed by exposing device 411 is performed.

Drum cleaning device 415 includes, for example, a flat drum cleaning blade made of an elastic body that is in contact with the surface of photoreceptor drum 413 and removes toner that fails to be transferred to intermediate transfer belt 421 and remains on the surface of photoreceptor drum 413.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is an endless belt and is looped over the plurality of support rollers 423. At least one of the plurality of support rollers 423 is a driving roller, and the other support rollers are driven rollers. For example, roller 423A disposed downstream of primary transfer roller 422 for the K component in the belt travel direction preferably serves as a driving roller. This configuration allows a travel speed of the belt in a primary transfer section to be easily kept constant. Rotation of driving roller 423A causes intermediate transfer belt 421 to travel at a constant speed in a direction of arrow A.

Intermediate transfer belt 421 is a belt having conductivity and elasticity and has a high resistance layer on a surface thereof. Intermediate transfer belt 421 is rotationally driven by a control signal from control section 101.

Primary transfer roller 422 is disposed on an inner peripheral surface side of intermediate transfer belt 421 and faces photoreceptor drum 413 for each color component. Pressing primary transfer roller 422 against photoreceptor drum 413 with intermediate transfer belt 421 interposed therebetween forms a primary transfer nip for transferring a toner image from photoreceptor drum 413 to intermediate transfer belt 421.

Secondary transfer roller 424 is disposed on an outer peripheral surface side of intermediate transfer belt 421 and faces backup roller 423B disposed on downstream of driving roller 423A in the belt travel direction. Pressing secondary transfer roller 424 against backup roller 423B with intermediate transfer belt 421 interposed therebetween forms a secondary transfer nip for transferring the toner image from intermediate transfer belt 421 to sheet S.

When intermediate transfer belt 421 passes through the primary transfer nip, the toner images on photoreceptor drums 413 are primarily transferred to intermediate transfer belt 421 to be sequentially superimposed on top of one another. Specifically, applying a primary transfer bias to primary transfer roller 422 and applying a charge having a polarity opposite to a polarity of a charge on the toner to a back surface side of intermediate transfer belt 421, that is, a side in contact with primary transfer roller 422, causes the toner image to be electrostatically transferred to intermediate transfer belt 421.

Thereafter, when sheet S passes through the secondary transfer nip, the toner image on intermediate transfer belt 421 is secondarily transferred to sheet S. Specifically, applying a secondary transfer bias to secondary transfer roller 424 and applying a charge having a polarity opposite to a polarity of a charge on the toner to a back surface side of sheet S, that is, a side in contact with secondary transfer roller 424, causes the toner image to be electrostatically transferred to sheet S. Sheet S to which the toner image has been transferred is conveyed toward fixing section 60.

Belt cleaning device 426 removes transfer residual toner remaining on the surface of intermediate transfer belt 421 after the secondary transfer.

Fixing section 60 includes upper fixing section 60A, lower fixing section 60B, a heating source, and the like, upper fixing section 60A including fixing surface side member disposed on a fixing surface side of sheet S, that is, a surface side on which the toner image is formed, and lower fixing section 60B including a back surface side support member disposed on a back surface side of sheet S, that is a surface side opposite to the fixing surface. Pressing the back surface side support member against the fixing surface side member forms a fixing nip for holding and conveying sheet S. Pressing/separating upper fixing section 60A and lower fixing section 60B against/from each other is performed by nip width adjusting section 68 (to be described later).

In fixing section 60, sheet S having the secondarily transferred toner image and conveyed is heated and pressurized at the fixing nip to cause the toner image to be fixed onto sheet S. Fixing section 60 is disposed as a unit in fixing unit F. Fixing section 60 corresponds to a "fixing device" of the present invention.

Upper fixing section 60A includes endless fixing belt 61, heating roller 62, and fixing roller 63 that constitute the fixing surface side member. Fixing belt 61 is stretched over heating roller 62 and fixing roller 63. Fixing belt 61 and fixing roller 63 correspond to a "second fixing section" of the present invention.

Lower fixing section 60B includes pressurizing roller 64 that is the back surface side support member. Between pressurizing roller 64 and fixing belt 61, a fixing nip for holding and conveying sheet S is formed. Pressurizing roller 64 corresponds to a "first fixing section" of the present invention.

Further, fixing section 60 is provided with warm-up state detecting section 73. Warm-up state detecting section 73 detects a warm-up state in fixing section 60. Warm-up state detecting section 73 includes a temperature sensor capable of detecting a fixing temperature in fixing section 60 and a temperature sensor capable of detecting an ambient temperature in the fixing section 60. Control section 101 controls the temperature of fixing section 60 based on a detection result of warm-up state detecting section 73.

Sheet conveying section 50 includes sheet feeding section 51, sheet discharging section 52, conveying route section 53, and the like. In three sheet feeding tray units 51*a* to 51*c* constituting sheet feeding section 51, sheets S (standard sheets, special sheets) classified based on a basis weight, a size, and the like are stored for each preset type. Conveying route section 53 includes a plurality of conveying roller pairs including resist roller pair 53*a*. A resist roller section in which resist roller pair 53*a* is disposed corrects inclination and deviation of sheet S.

Sheets S stored in sheet feeding tray units 51*a* to 51*c* are fed out one by one from an uppermost section and are conveyed to image forming section 40 through conveying route section 53. In image forming section 40, toner images on intermediate transfer belt 421 are secondarily transferred to one surface of sheet S collectively and are subjected to a fixing process in fixing section 60. Sheet S on which the image has been formed is discharged to the outside by sheet discharging section 52 including sheet discharging roller 52*a*.

Further, fixing section 60 includes, as shown in FIG. 2, first motor 65, second motor 66, rotation speed detecting section 67, nip width adjusting section 68 in addition to upper fixing section 60A and lower fixing section 60B.

First motor 65 transmits, to pressurizing roller 64, a drive force for rotating pressurizing roller 64 at a desired rotation speed. Second motor 66 transmits, to fixing roller 63, a drive force having torque lower than torque of the drive force of first motor 65.

Preferably, second motor 66 generates constant torque under the control of control section 101 to make a rotation speed of lower fixing section 60B close to the rotation speed of pressurizing roller 64 with lower fixing section 60B separated from upper fixing section 60A.

Here, when upper fixing section 60A and lower fixing section 60B are shifted from the state where upper fixing section 60A and lower fixing section 60B are separated from each other to the state where upper fixing section 60A and lower fixing section 60B are pressed against each other, pressing fixing belt 61 and fixing roller 63 that are not rotating against pressurizing roller 64 that is being rotated by first motor 65 may fail to smoothly pressing upper fixing section 60A and lower fixing section 60B against each other.

Therefore, in the present embodiment, upper fixing section 60A and lower fixing section 60B are pressed against each other with fixing belt 61 and fixing roller 63 being rotated by second motor 66. This causes fixing belt 61 and fixing roller 63 to be pressed against pressurizing roller 64 with fixing belt 61 and fixing roller 63 rotating, which allows upper fixing section 60A and lower fixing section 60B to be smoothly pressed against each other and allows a stable pressing/separating operation.

Further, torque of the drive force of second motor 66 is lower than torque of the drive force of first motor 65, which causes fixing belt 61 and fixing roller 63 to follow the rotation of pressurizing roller 64 after fixing belt 61 and fixing roller 63 are pressed against pressurizing roller 64.

The rotation speed of fixing belt 61 and fixing roller 63 is detected by rotation speed detecting section 67. Rotation speed detecting section 67 is, for example, an encoder. Control section 101 controls the rotation speed of fixing belt 61 and fixing roller 63 in accordance with a detection result of rotation speed detecting section 67. Note that rotation speed detecting section 67 may be of any type as long as it is capable of detecting the rotation speed of fixing belt 61 and fixing roller 63. In a configuration where an encoder is used as rotation speed detecting section 67, for example, an angular speed expressed in rpm is detected, but what to be detected by rotation speed detecting section 67 is not limited to the angular speed and may be other values that can be converted into a peripheral speed based on a size of the roller or may be the peripheral speed per se.

Figure 3:
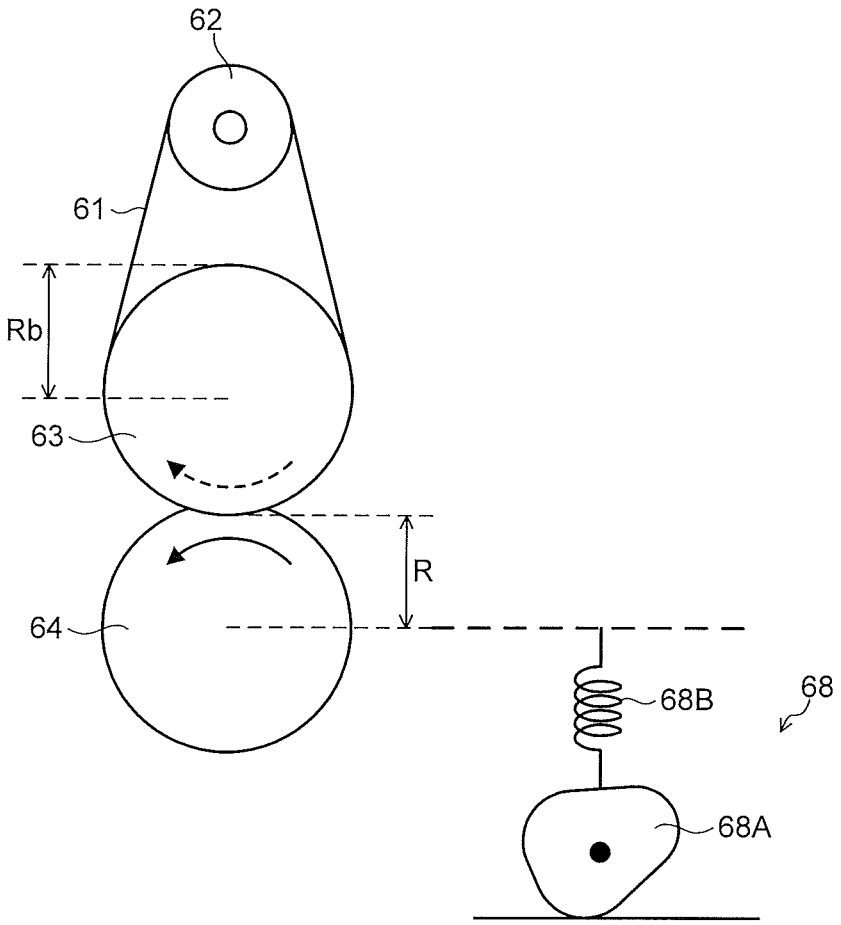
FIG. 3 is a diagram for describing a relationship between a fixing section and a nip width adjusting section.

As shown in FIG. 3, nip width adjusting section 68 includes cam 68A that is rotatable and energizing member 68B that energizes a rotation shaft of pressurizing roller 64 to move toward fixing roller 63. Cam 68A is rotated by a drive section (not shown). Drive of the drive section is controlled by control section 101. Energizing member 68B energizes pressurizing roller 64 by directly or indirectly pressing pressurizing roller 64 toward fixing roller 63.

In nip width adjusting section 68, the rotation of cam 68A causes energizing member 68B to control an amount of pressing for the rotation shaft of pressurizing roller 64. This configuration causes an inter-shaft distance between a rotation shaft of fixing roller 63 and the rotation shaft of pressurizing roller 64 to be adjusted. A surface of pressurizing roller 64 is made of rubber, which causes the adjustment of the inter-shaft distance to adjust an amount of deformation of pressurizing roller 64 at the fixing nip, that is, a nip width of the fixing nip.

[Setting of Reference Nip Width]

In image forming apparatus 1, various types of media are used. Various types of media include media having different basis weights, media to which coatings are applied, media to which no coating is applied, media made of different materials, media of different paper types such as an envelope and embossed paper. However, appropriate nip widths of media at the fixing nip may be different from each other, which requires that appropriate nip widths of various media be managed in order to fix an image onto such media with high quality.

For example, for thick paper, it is preferable to increase the nip width in order to firmly transfer heat to the thick paper in fixing section 60. In contrast, for thin paper, it is preferable to decrease the nip width because the thin paper does not require a large amount of heat and easily wrinkles if the nip width is large.

As described above, the appropriate nip widths are different for each type of sheet, which causes control section 101 to control nip width adjusting section 68 to make the nip width equal to a predetermined reference nip width for each type of sheet. The reference nip width is a nip width preset for each type of sheet that prevents fixing failure.

In storing section 72, the reference nip width is stored for each type of sheet. Specifically, in storing section 72, a reference position of cam 68A is stored for each type of sheet as the inter-shaft distance corresponding to the reference nip width. The reference position of cam 68A is set so that the nip width of the fixing nip equals to the reference nip width. Control section 101 acquires the reference position of cam 68A from storing section 72 in accordance with the type of sheet and controls nip width adjusting section 68 using the reference position. As a result, the reference nip width of the fixing nip can be set to an appropriate width in accordance with the type of sheet.

Further, fixing section 60 may include a storing section in which the reference nip width is stored. The reference position of cam 68A as the reference nip width, that is, the inter-shaft distance that achieves an appropriate nip width is determined based on individual variations such as hardness and spring pressure of the roller member in fixing section 60. For this reason, an adjustment value adjusted by a measuring device such as a load cell so that pressure is uniformly distributed is stored in the storing section of the fixing section 60. This configuration allows, even after fixing section 60 is replaced, the nip width to be adjusted using the reference nip width stored in the storing section of fixing section 60 after the replacement, which allows the nip width to be adjusted based on the individual variations of fixing sections 60.

[Adjustment Control of Nip Width]

Meanwhile, the nip width may vary depending on a degree of expansion of the fixing member such as pressurizing roller 64 due to a change in the warm-up state in fixing section 60 or a condition other than media such as a degree of sag in the fixing member.

The surface of pressurizing roller 64 contains rubber; thus, rubber hardness of the surface varies as a result of repeated heating for fixing applied to the surface. Specifically, as shown in FIG. 4, as a cumulative heating time increases, the rubber hardness increases.

Figure 4:
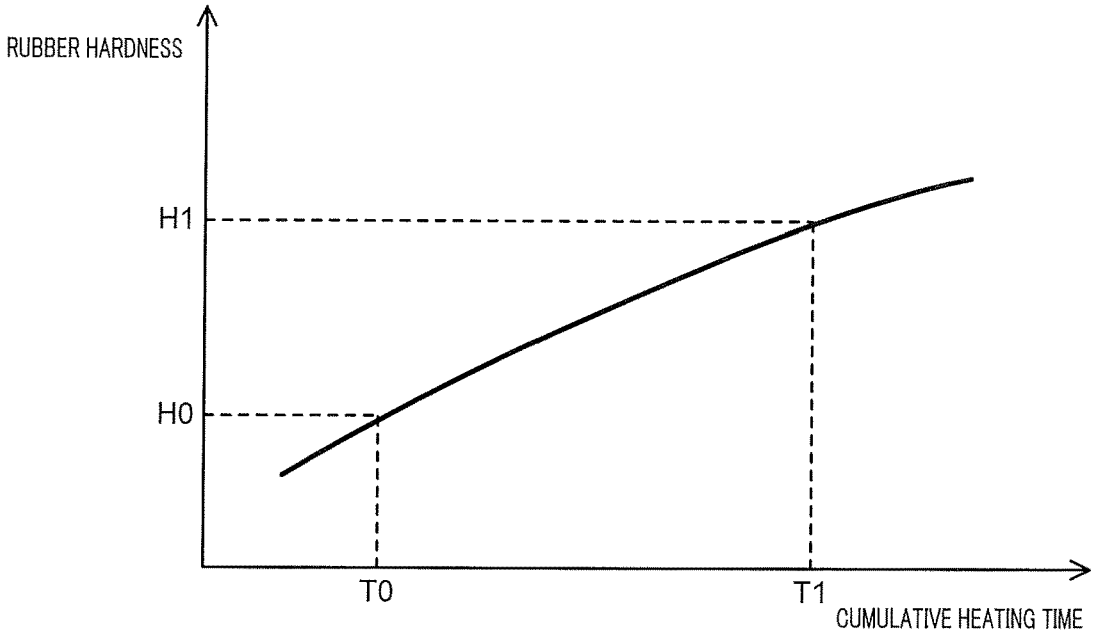
FIG. 4 is a graph showing rubber hardness of a pressurizing roller with respect to a cumulative heating time.

In the example shown in FIG. 4, cumulative heating time T1 is a time in 2000 hours from cumulative heating time T0. On the assumption that rubber hardness H0 at cumulative heating time T0 is defined as an initial value and rubber hardness H1 at cumulative heating time T1 and rubber hardness H0 are used, nip width W of the fixing nip can be expressed by the following equation (1). In equation (1), W0 denotes an initial value of the nip width of the fixing nip, and β denotes a correction coefficient for converting the rubber hardness into the nip width of the fixing nip.

$$W=W0\times(H0/H1)\times\beta \quad (1)$$

Considering a relationship between the fact that the rubber hardness increases as the cumulative heating time increases and equation (1), the nip width decreases with time. This is because, as the rubber hardness of pressurizing roller 64 increases, a force for pushing pressurizing roller 64 back toward fixing roller 63 and fixing belt 61 against energizing member 68B increases, and as a result the inter-shaft distance increases.

Such a variation in the nip width may cause a problem that fixability in fixing section 60 is deteriorated or fixing failure, for example, generation of wrinkles on thin paper occurs while the thin paper is passing through.

As described above, pressurizing roller 64 is pressed against fixing belt 61 and fixing roller 63, which causes pressurizing roller 64 to deform. Therefore, as compared with a case where pressurizing roller 64 is not pressed against fixing belt 61 and fixing roller 63, a diameter of pressurizing roller 64 has become substantially smaller. Thus, it is considered that the diameter of pressurizing roller 64 will become substantially larger and larger with time as the inter-shaft distance increases due to a change with time in the rubber hardness of pressurizing roller 64.

As described above, as the diameter of pressurizing roller 64 varies, the nip width deviates from the reference nip width. In order to prevent the nip width from deviating from the reference nip width, it is conceivable to keep the inter-shaft distance constant or to quantitatively control the inter-shaft distance, but both the methods require that the current configuration be changed, which in turn requires man-hours and costs. In view of the above, the inventor of the present application has found that a correspondence relationship between the nip width and the rotation speed, that is, as the nip width of the fixing nip varies, the rotation speed of fixing roller 63 and fixing belt 61 that follow the rotation of pressurizing roller 64 varies. Specifically, as shown in FIG. 5, the rotation speed of fixing roller 63 and fixing belt 61 increase as the diameter of pressurizing roller 64 increases, that is, as the inter-shaft distance increases, the rotation speed increases.

Figure 5:
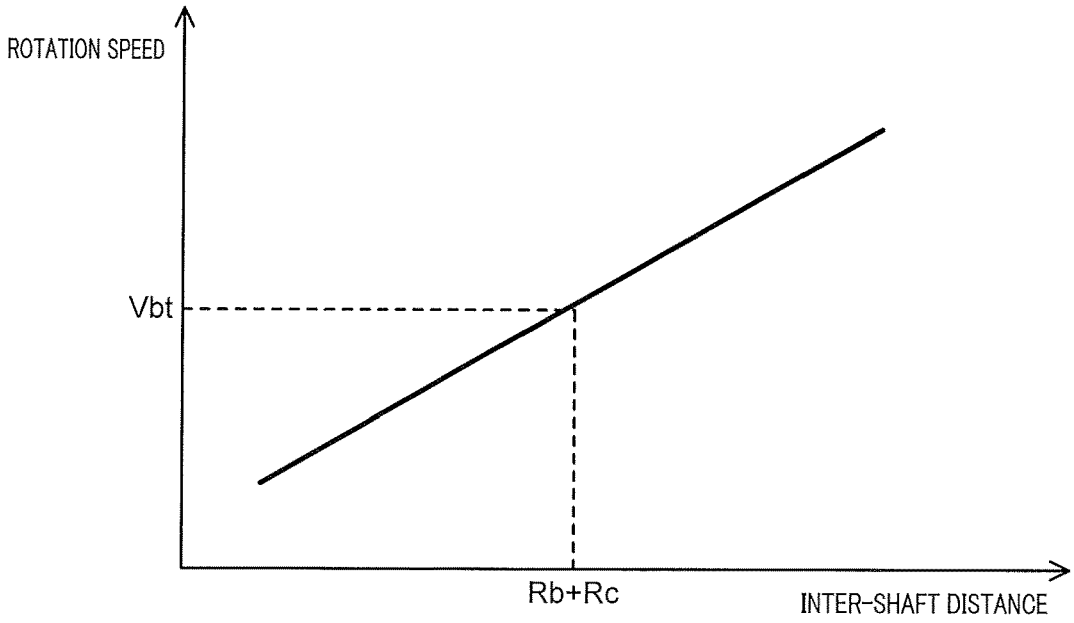
FIG. 5 is a graph showing a rotation speed of a fixing roller with respect to an inter-shaft distance.

With reference to FIG. 5, the relationship between the rotation speed of fixing roller 63 and fixing belt 61 and the inter-shaft distance is expressed by the following equation (2). In equation (2), a radius of fixing roller 63 is denoted by Rb, a radius of pressurizing roller 64 is denoted by R, the rotation speed of pressurizing roller 64 is denoted by V0, and the rotation speed of fixing roller 63 and fixing belt 61 is denoted by Vb. Accordingly, the inter-shaft distance is denoted by Rb+R, and when the radius of pressurizing roller 64 corresponding to the reference nip width is denoted by Rc, the inter-shaft distance is denoted by Rb+Rc. Note that the example shown in FIG. 5 shows the rotation speed of fixing roller 63 and fixing belt 61 on the assumption that fixing roller 63 does not deform, that is, radius Rb of fixing roller 63 is constant because a deformation amount of pressurizing roller 64 is excessively greater than a deformation amount of fixing roller 63 and fixing belt 61.

$$Vb=V0/Rb\times R \quad (2)$$

With reference to FIG. 5 and equation (2), the substantial variation in the diameter of pressurizing roller 64, that is, the variation in the inter-shaft distance between the rotation shaft of pressurizing roller 64 and the rotation shaft of fixing roller 63, causes rotation speed Vb to vary. Since the nip width varies as the inter-shaft distance varies, it can be seen that rotation speed Vb varies as the nip width varies.

Therefore, control section 101 controls nip width adjusting section 68 based on the detection result of rotation speed detecting section 67 to make the nip width equal to the predetermined reference nip width.

For example, when the diameter of pressurizing roller 64 corresponding to the reference nip width is denoted by Rc, that is, the inter-shaft distance is denoted by Rb+Rc, in the case of FIG. 5, rotation speed Vb is equal to reference rotation speed Vbt. However, when the inter-shaft distance is greater than Rb+Rc and the nip width is less than the reference nip width, rotation speed Vb is greater than reference rotation speed Vbt. That is, rotation speed Vb detected by rotation speed detecting section 67 is greater than the reference rotation speed.

Therefore, when rotation speed Vb is greater than the reference rotation speed, control section 101 performs control to increase the nip width. Specifically, control section 101 controls nip width adjusting section 68 to move pressurizing roller 64 toward fixing belt 61 and fixing roller 63 to decrease the inter-shaft distance, so that rotation speed Vb detected by rotation speed detecting section 67 is equal to the reference rotation speed. Accordingly, the nip width of the fixing nip can be easily adjusted to the predetermined reference nip width, which makes it possible to suppress the fixing failure due to the variation in the nip width.

Note that the reference rotation speed corresponds to a rotation speed that is measured when cam 68A is set to the reference position to make the nip width equal to the reference nip width with fixing section 60 in a default state and is stored in storing section 72 or the like. The default state corresponds to, for example, a state where image forming apparatus 1 or fixing section 60 newly arrives or a state immediately after replacement with new fixing roller 63, pressurizing roller 64, or other components in fixing section 60. Further, the nip width (reference nip width) in the default state is an optimum width that prevents fixing failure or the like from occurring on a sheet, and is secured by the reference position of cam 68A.

Further, control section 101 causes rotation speed detecting section 67 to detect rotation speed Vb in a period where no sheet is passing through the fixing nip. In a case where rotation speed Vb is detected by rotation speed detecting section 67 while a sheet is passing through, it is considered that accurate detection of rotation speed Vb is difficult due to the influence of disturbance such as the sheet passing through the fixing nip. Therefore, detection of rotation speed Vb while no sheet is passing through allows accurate detection of rotation speed Vb.

Further, control section 101 sets the reference nip width in accordance with the detection result of the warm-up state detecting section 73. A warm-up state where fixing section 60 has reached the fixing temperature (for example, 180° C.) and the ambient temperature of fixing section 60 has not reached a predetermined temperature (for example, 70° C.) (hereinafter, referred to as "before warming up") and a warm-up state where the ambient temperature of fixing section 60 has reached the predetermined temperature (hereinafter, referred to as "after warming up") are different in fixability from each other even under the same temperature control. For this reason, control for setting a reference nip width suitable for each of before warming up and after warming up allows fixing suitable for the warm-up state to be performed, which in turn makes fixability stable. Specifically, control section 101 causes the temperature sensor capable of detecting the fixing temperature to detect whether a surface temperature of fixing belt 61 has reached the fixing temperature, and causes the temperature sensor capable of detecting the ambient temperature to detect whether the ambient temperature in the vicinity of fixing belt 61 or fixing roller 63 has reached the predetermined temperature.

[Correction of Reference Nip Width]

Meanwhile, due to a change with time of pressurizing roller 64, the rubber hardness of pressurizing roller 64 increases and the nip width decreases. Therefore, control for decreasing the inter-shaft distance, that is, increasing the nip width by increasing a pressing force acting on pressurizing roller 64 is performed. However, since pressurizing roller 64 hardens, a large force is required to increase the nip width up to the reference nip width, which may have an adverse effect in consideration of durability of the fixing member and the like. In such a case, the reference nip width is corrected so that the pressing force acting on pressurizing roller 64 is appropriately maintained.

Specifically, control section 101 controls nip width adjusting section 68 to correct the reference rotation speed corresponding to the reference nip width in accordance with at least one of a heating time of heating roller 62 and a nip time during which the fixing nip is formed between pressurizing roller 64, and fixing belt 61 and fixing roller 63. When at least one of the heating time and the nip time becomes greater than the predetermined time, control section 101 corrects the reference rotation speed to decrease the reference nip width. In this case, in nip width adjustment control (to be described later), the reference nip width is set to the reference nip width after correction, and the position of cam 68A is controlled so that the rotation speed of fixing roller 63 is equal to the reference rotation speed after correction. This allows the pressing force acting on pressurizing roller 64 to be appropriately maintained. Note that the predetermined time is appropriately set to, for example, 2000 hours based on the material of the fixing member. Further, the heating time and the nip time are each a cumulative time from when fixing section 60 is in the default state.

However, the correction for decreasing the reference nip width may cause fixing failure. Therefore, in order to compensate for the variation due to the correction, control section 101 performs control for correcting the heating amount in heating roller 62 based on the correction amount of the reference nip width. Heating roller 62 corresponds to a "heating section" of the present invention.

Specifically, after performing the correction for decreasing the reference nip width, control section 101 corrects the heating amount in heating roller 62 to increase the heating amount. Such correction causes the decrease in the reference nip width to be canceled out, which makes it is possible to suppress occurrence of fixing failure due to the variation in the nip width while appropriately maintaining the pressing force acting on pressurizing roller 64.

[Lifetime Determination]

Figure 6:
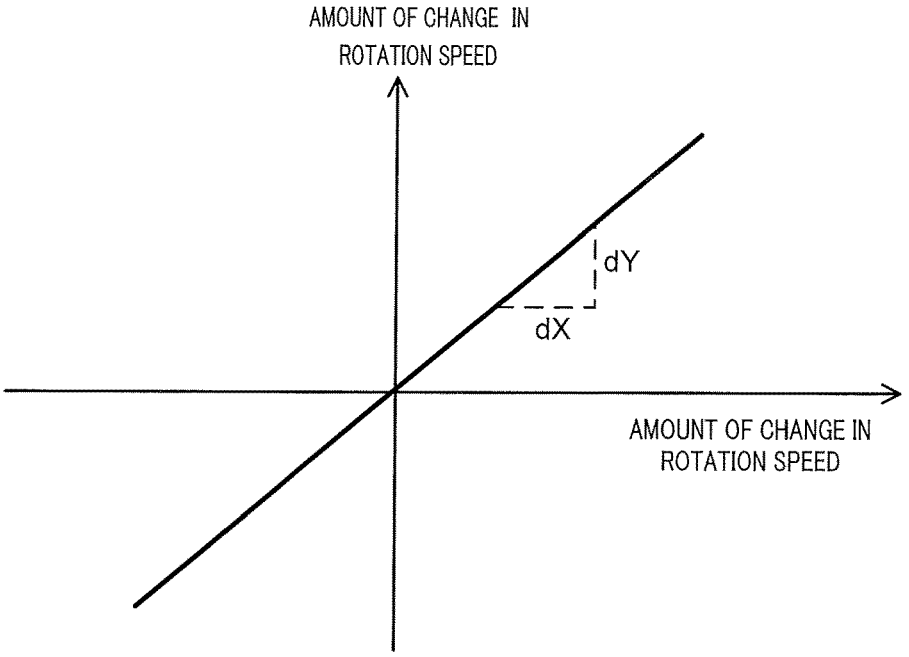
FIG. 6 is a graph showing an amount of change in the rotation speed of the fixing roller with respect to an amount of adjustment for the inter-shaft distance.

Meanwhile, it has been confirmed that the amount of change in the rotation speed of fixing roller 63 varies depending on the amount of adjustment for the inter-shaft distance. For example, as shown in FIG. 6, when pressurizing roller 64 has predetermined rubber hardness, the amount of change in the rotation speed of fixing roller 63 with respect to the amount of adjustment for the inter-shaft distance linearly increases. That is, when the rubber hardness of pressurizing roller 64 is constant, ratio $\alpha$ between the amount of adjustment for the inter-shaft distance and the amount of change in the rotation speed with respect to the amount of adjustment for the inter-shaft distance is constant. Note that ratio $\alpha$ is a quotient obtained by dividing change dY in the rotation speed by change dX in the amount of adjustment for the inter-shaft distance.

However, it is considered that as the rubber hardness of pressurizing roller 64 increases with time, pressurizing roller 64 becomes less likely to deform at the fixing nip, thereby making ratio $\alpha$ lower. That is, it is considered that ratio $\alpha$ decreases with time.

Figure 7:
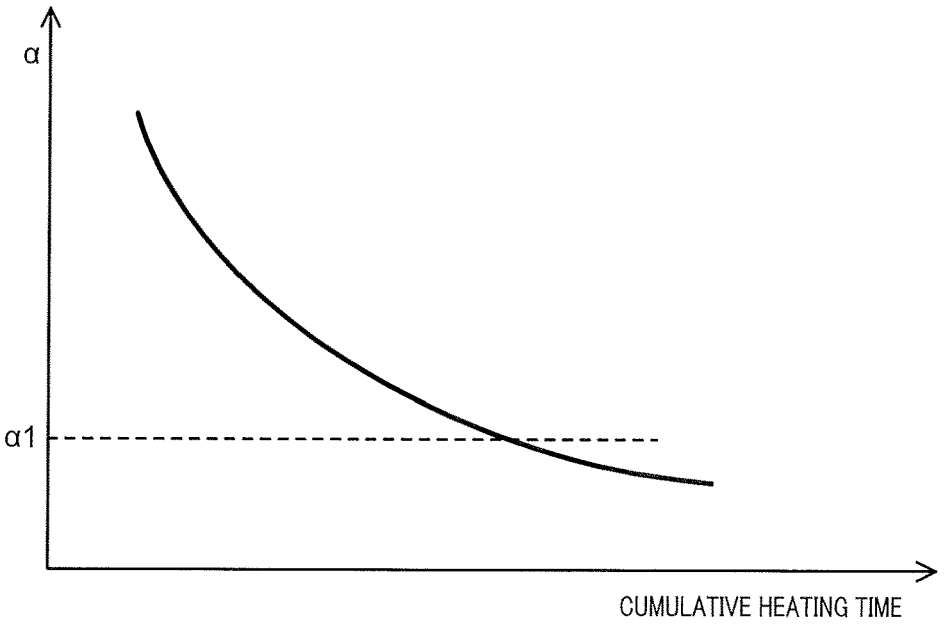
FIG. 7 is a graph showing a ratio between the amount of adjustment for the inter-shaft distance and the amount of change in the rotation speed of the fixing roller.

Specifically, as shown in FIG. 7, it has been confirmed that ratio $\alpha$ decreases as the cumulative heating time at the fixing nip increases. Further, it is considered that because there is a limit to the amount of adjustment for the inter-shaft distance between the rotation shaft of pressurizing roller 64 and the rotation shaft of fixing roller 63, a decrease in ratio $\alpha$ to some extent makes it impossible to set the rotation speed of fixing roller 63 to a desired rotation speed.

It is considered that pressurizing roller 64 has reached the end of life because the nip width of the fixing nip cannot be adjusted when the rotation speed of fixing roller 63 fails to be set to the desired rotation speed. Therefore, control section 101 causes, for example, storing section 72 or the like to store a history of the amount of adjustment for the inter-shaft distance and a history of the amount of change in the rotation speed with respect to the amount of adjustment for the inter-shaft distance and, when ratio $\alpha$ between the amount of adjustment for the inter-shaft distance and the amount of change in the rotation speed of fixing roller 63 with respect to the amount of adjustment for the inter-shaft distance is equal to predetermined value $\alpha 1$, determines that pressurizing roller 64 has reached the end of life. Note that predetermined value $\alpha 1$ is set in accordance with, for example, the diameter of fixing roller 63, the diameter of pressurizing roller 64, the size of cam 68A, the drive section that drives cam 68A, and the like.

This configuration allows determination of the life of pressurizing roller 64 to be quickly performed, thereby allowing replacement of a component of fixing section 60 to be performed at an appropriate timing and making it possible to prevent occurrence of fixing failure due to a change in the nip width of the fixing nip.

Further, when the amount of adjustment for the inter-shaft distance exceeds the predetermined amount, control section 101 may determine that pressurizing roller 64 has reached the end of life. The predetermined amount is set to any value such as a maximum adjustment amount for the inter-shaft distance. Further, when ratio $\alpha$ is equal to the predetermined value, control section 101 may determine that fixing roller 63 has reached the end of life, or fixing roller 63 and pressurizing roller 64 have reached the end of life.

Further, when determining that pressurizing roller 64 or the like has reached the end of life, control section 101 may output an alarm to urge replacement of pressurizing roller 64 or the like. Specifically, control section 101 causes operation display section 20 or the like of image forming apparatus 1 to display the fact that pressurizing roller 64 has reached the end of life or causes an alarm sound or the like to be emitted from image forming apparatus 1. This allows the user to easily grasp a replacement timing of pressurizing roller 64.

Figure 8:
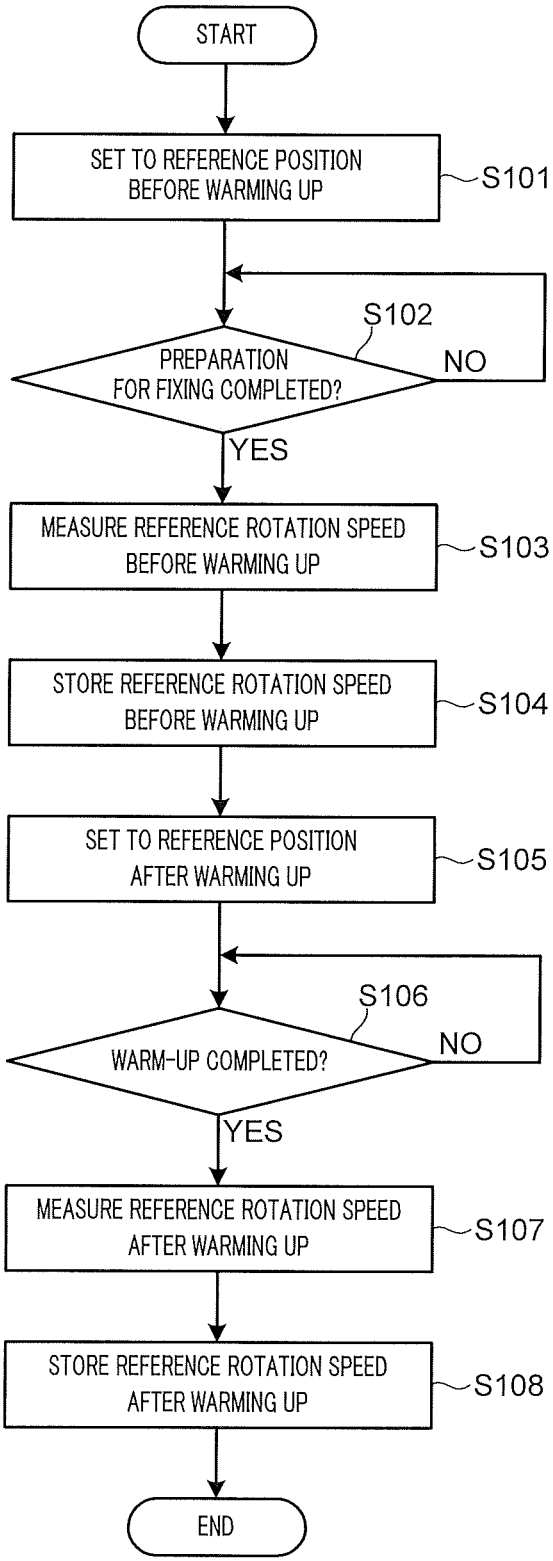
FIG. 8 is a flowchart showing an example of operation when measurement control of a reference rotation speed for the fixing roller is performed.

Next, a description will be given of an example of operation when control is performed in image forming apparatus 1. First, an example of operation of control for measuring the reference rotation speed for fixing roller 63 will be described. FIG. 8 is a flowchart showing an example of operation when measurement control of the reference rotation speed for fixing roller 63 is performed. The processing shown in FIG. 8 is appropriately performed when, for example, in a state where image forming apparatus 1 newly arrives or in a state immediately after replacement with new fixing roller 63, pressurizing roller 64, or other components in fixing section 60, image forming apparatus 1 is powered on.

As shown in FIG. 8, after fixing section 60 is driven, control section 101 controls nip width adjusting section 68 to set to the reference position of cam 68A corresponding to the reference nip width before warming up (step S101). Next, control section 101 determines whether preparations for fixing have been completed (step S102). Note that, based on the fact that fixing section 60 has reached the fixing temperature, the determination is made that the preparations for fixing have been completed.

When the determination indicates that the preparations for fixing have not been completed (NO in step S102), step S102 is repeated. In contrast, when the preparations for fixing have been completed (YES in step S102), control section 101 measures the reference rotation speed before warming up (step S103). Next, control section 101 stores the reference rotation speed before warming up thus measured in storing section 72 (step S104).

Next, control section 101 controls nip width adjusting section 68 to set to the reference position of cam 68A corresponding to the reference nip width after warming up (step S105). Next, control section 101 determines whether the warm-up has been completed (step S106). Note that, based on the fact that the ambient temperature in fixing section 60 has reached the predetermined temperature, the determination is made that the warm-up has been completed.

When the determination indicates that the warm-up has not been completed (NO in step S106), step S106 is repeated. In contrast, when the warm-up has been completed (YES in step S106), control section 101 measures the reference rotation speed after warming up (step S107). Next, control section 101 stores the reference rotation speed after warming up in storing section 72 (step S108). After step S108, this control comes to an end.

Figure 9:
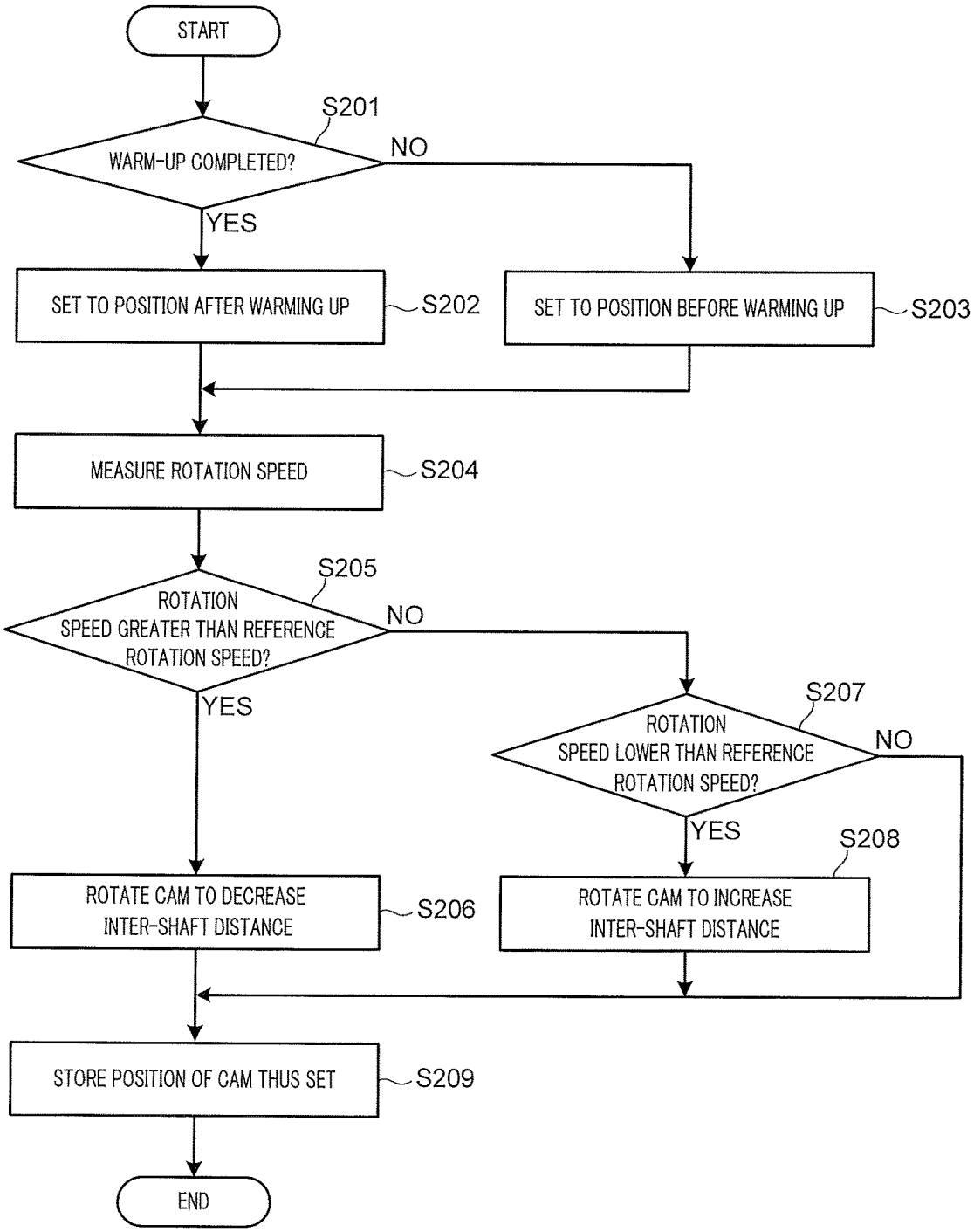
FIG. 9 is a flowchart showing an example of operation when nip width adjustment control is performed in the image forming apparatus.

Next, a description will be given of an example of operation of the nip width adjustment control in image forming apparatus 1. FIG. 9 is a flowchart showing an example of operation when the nip width adjustment control is performed in image forming apparatus 1. The processing shown in FIG. 9 is performed when, for example, control section 101 receives a command to perform a print process.

As shown in FIG. 9, control section 101 determines whether the warm-up has been completed (step S201). When the determination indicates that the warm-up has been completed (YES in step S201), control section 101 controls nip width adjusting section 68 to set to the position of cam 68A corresponding to the reference nip width after warming up (step S202). In contrast, when the warm-up has not been completed (NO in step S201), control section 101 controls nip width adjusting section 68 to set to the position of cam 68A corresponding to the reference nip width before warming up (step S203). Note that, herein, the position of cam 68A refers to the position stored in storing section 72, and, in the default state, refers to the reference position.

Next, control section 101 measures the rotation speed of fixing roller 63 (step S204). Next, control section 101 determines whether the rotation speed thus measured is greater than the reference rotation speed (step S205).

When the determination indicates that the rotation speed is greater than the reference rotation speed (YES in step S205), control section 101 rotates cam 68A to decrease the inter-shaft distance (step S206). Specifically, control section 101 controls the position of cam 68A by rotating cam 68A until the rotation speed is equal to the reference rotation speed.

In contrast, when the rotation speed is equal to or lower than the reference rotation speed (NO in step S205), control section 101 determines whether the rotation speed is lower than the reference rotation speed (step S207). When the determination indicates that the rotation speed is not lower than the reference rotation speed, that is, the rotation speed is equal to the reference rotation speed (NO in step S207), the process proceeds to step S209 without changing the inter-shaft distance.

In contrast, when the rotation speed is lower than the reference rotation speed (YES in step S207), control section 101 rotates cam 68A to increase the inter-shaft distance (step S208). Specifically, control section 101 controls the position of cam 68A by rotating cam 68A until the rotation speed is equal to the reference rotation speed.

Next, control section 101 stores the position of cam 68A thus set in storing section 72, the position corresponding to the reference nip width (step S209). After step S209, this control comes to an end.

According to the present embodiment as described above, nip width adjusting section 68 is controlled based on the detection result of rotation speed detecting section 67 to make the nip width of the fixing nip equal to the reference nip width. That is, even if the nip width varies depending on a degree of expansion of the fixing member due to a change in the warm-up state in fixing section 60, a sag in the fixing member, or the like, this makes it possible to easily detect the variation in the nip width and adjust the nip width to an appropriate width. As a result, fixing failure due to a change in the nip width can be suppressed.

Further, since the variation in the nip width is detected through detection of the rotation speed of fixing belt 61 and fixing roller 63, the variation in the nip width due to the variation in the diameter of pressurizing roller 64 can be detected with a relatively simple configuration.

Note that, in the above-described embodiment, fixing belt 61 and fixing roller 63 follow the rotation of pressurizing roller 64, but the present invention is not limited to such a configuration, and pressurizing roller 64 may follow fixing belt 61 and fixing roller 63.

In the above-described embodiment, the fixing nip is formed by fixing belt 61 and pressurizing roller 64, but the present invention is not limited to such a configuration, and the fixing nip may be formed by fixing roller 63 without the fixing belt, and pressurizing roller 64.

Further, in the above-described embodiment, the configuration including heating roller 62 as the heating section has been given as an example, but the present invention is not limited to such a configuration, and fixing roller 63 may include the heating section, for example.

In the above-described embodiment, the nip width is adjusted by adjusting the inter-shaft distance between the rotation shaft of fixing roller 63 and the rotation shaft of pressurizing roller 64, but the present invention is not limited to such a configuration. For example, nip width adjusting section 68 may have a mechanism different from the mechanism including cam 68A and energizing member 68B or may be configured not to adjust the inter-shaft distance as long as nip width adjusting section 68 is capable of adjusting the nip width.

The above-described embodiment is merely an example showing an embodiment for implementing the present invention, and the technical scope of the present invention should not be construed as being limited by the embodiment. That is, the present invention may be implemented in various forms without departing from the gist or the main features thereof.

Although embodiments of the present invention have been described and illustrated in detail, the disclosed embodiments are made for purposes of illustration and example only and not limitation. The scope of the present invention should be interpreted by terms of the appended claims.

What is claimed is:

1. A fixing device that fixes a toner image onto a sheet passing through a fixing nip, comprising:

a first fixer that receives a first drive force to rotate;

a second fixer that rotates following rotation of the first fixer, the first fixer and the second fixer forming the fixing nip therebetween;

a nip width adjuster capable of adjusting a nip width of the fixing nip;

a rotation speed detector that detects a rotation speed of the second fixer; and a hardware processor that controls the nip width adjuster based on a detection result of the rotation speed detector to make the nip width equal to a predetermined reference nip width, wherein the nip width adjuster adjusts the nip width by adjusting a relative distance between the first fixer and the second fixer, and the hardware processor determines that at least one of the first fixer and the second fixer has reached an end of life when an amount of adjustment for the relative distance exceeds a predetermined amount.

2. The fixing device according to claim 1, wherein the hardware processor controls the nip width adjuster to make the rotation speed equal to a reference rotation speed corresponding to the reference nip width.

3. The fixing device according to claim 2, further comprising a storage that stores the reference rotation speed corresponding to the reference nip width.

4. The fixing device according to claim 3, wherein the reference nip width is determined for each type of the sheet.

5. The fixing device according to claim 4, further comprising a warm-up state detector that detects a warm-up state in the fixing device, wherein the hardware processor sets the reference nip width in accordance with a detection result of the warm-up state detector.

6. The fixing device according to claim 1, wherein the reference nip width is a nip width of the fixing nip between the first fixer and the second fixer in a default state, and the hardware processor controls the rotation speed detector to detect the rotation speed of the second fixer in the default state as the reference rotation speed corresponding to the reference nip width.

7. The fixing device according to claim 6, wherein the default state is a state when the fixing device newly arrives or a state immediately after replacement of at least one of the first fixer and the second fixer.

8. The fixing device according to claim 1, wherein each of the first fixer and the second fixer includes a roller member having a rotation shaft, and the relative distance is an inter-shaft distance between the rotation shaft of the roller member of the first fixer and the rotation shaft of the roller member of the second fixer.

9. The fixing device according to claim 1, wherein when determining that one or both of the first fixer and the second fixer have reached the end of life, the hardware processor outputs an alarm to urge replacement of one or both of the first fixer and the second fixer.

10. The fixing device according to claim 1, further comprising a heater that heats one of the first fixer and the second fixer, wherein the hardware processor corrects the reference nip width in accordance with at least one of a heating time of the heater and a nip time during which the fixing nip is formed between the first fixer and the second fixer, and controls the nip width adjuster to set the reference nip width after correction as the reference nip width.

11. The fixing device according to claim 10, wherein the hardware processor adjusts a heating amount of the heater in accordance with the reference nip width after correction.

12. The fixing device according to claim 1, wherein a second drive force having torque lower than torque of the first drive force is transmittable to the second fixer.

13. The fixing device according to claim 12, wherein to cause the first fixer and the second fixer to be shifted from a state where the first fixer and the second fixer are separated from each other to a state where the first fixer and the second fixer are pressed against each other, the hardware processor controls the nip width adjuster to make the shift with the second drive force transmitted to the second fixer.

14. The fixing device according to claim 1, wherein the rotation speed detector detects the rotation speed of the second fixer in a period where the sheet does not pass through the fixing nip, and the hardware processor controls the nip width adjuster in a period where the sheet does not pass through the fixing nip.

15. The fixing device according to claim 1, wherein the nip width adjuster includes a cam member that is rotatable and an energizing member that energizes the second fixer to move toward the first fixer and is capable of adjusting an amount of energizing for the second fixer through rotation of the cam member.

16. An image forming apparatus comprising:

a first fixer that receives a first drive force to rotate;

a second fixer that rotates following rotation of the first fixer, the first fixer and the second fixer forming a fixing nip therebetween;

a nip width adjuster capable of adjusting a nip width of the fixing nip;

a rotation speed detector that detects a rotation speed of the second fixer; and a hardware processor that controls the nip width adjuster based on a detection result of the rotation speed detector to make the nip width equal to a predetermined reference nip width, wherein the nip width adjuster adjusts the nip width by adjusting a relative distance between the first fixer and the second fixer, and the hardware processor determines that at least one of the first fixer and the second fixer has reached an end of life when an amount of adjustment for the relative distance exceeds a predetermined amount.

17. A fixing device that fixes a toner image onto a sheet passing through a fixing nip, comprising:

a first fixer that receives a first drive force to rotate;

a second fixer that rotates following rotation of the first fixer, the first fixer and the second fixer forming the fixing nip therebetween;

a nip width adjuster capable of adjusting a nip width of the fixing nip;

a rotation speed detector that detects a rotation speed of the second fixer; and a hardware processor that controls the nip width adjuster based on a detection result of the rotation speed detector to make the nip width equal to a predetermined reference nip width, wherein the nip width adjuster adjusts the nip width by adjusting a relative distance between the first fixer and the second fixer, and the hardware processor determines that at least one of the first fixer and the second fixer has reached an end of life when a ratio between the amount of adjustment for the relative distance and an amount of change in the rotation speed of the second fixer with respect to the amount of adjustment for the relative distance is equal to or less than a predetermined value.

18. The fixing device according to claim 17, further comprising a storage that stores the reference rotation speed corresponding to the reference nip width, wherein the storage stores a history of the amount of adjustment for the relative distance and a history of the amount of change in the rotation speed with respect to the amount of adjustment for the relative distance.

19. An image forming apparatus comprising:

a first fixer that receives a first drive force to rotate;

a second fixer that rotates following rotation of the first fixer, the first fixer and the second fixer forming a fixing nip therebetween;

a nip width adjuster capable of adjusting a nip width of the fixing nip;

a rotation speed detector that detects a rotation speed of the second fixer; and a hardware processor that controls the nip width adjuster based on a detection result of the rotation speed detector to make the nip width equal to a predetermined reference nip width, wherein the nip width adjuster adjusts the nip width by adjusting a relative distance between the first fixer and the second fixer, and the hardware processor determines that at least one of the first fixer and the second fixer has reached an end of life when a ratio between the amount of adjustment for the relative distance and an amount of change in the rotation speed of the second fixer with respect to the amount of adjustment for the relative distance is equal to or less than a predetermined value.

20. A fixing device that fixes a toner image onto a sheet passing through a fixing nip, comprising:

a first fixer that receives a first drive force to rotate;

a second fixer that rotates following rotation of the first fixer, the first fixer and the second fixer forming the fixing nip therebetween;

a nip width adjuster capable of adjusting a nip width of the fixing nip;

a rotation speed detector that detects a rotation speed of the second fixer; and a hardware processor that controls the nip width adjuster based on a detection result of the rotation speed detector to make the nip width equal to a predetermined reference nip width, wherein a second drive force having torque lower than torque of the first drive force is transmittable to the second fixer.

21. An image forming apparatus comprising:

a first fixer that receives a first drive force to rotate;

a second fixer that rotates following rotation of the first fixer, the first fixer and the second fixer forming a fixing nip therebetween;

a nip width adjuster capable of adjusting a nip width of the fixing nip;

a rotation speed detector that detects a rotation speed of the second fixer; and a hardware processor that controls the nip width adjuster based on a detection result of the rotation speed detector to make the nip width equal to a predetermined reference nip width, wherein a second drive force having torque lower than torque of the first drive force is transmittable to the second fixer.

* * * * *